US011780226B2

(12) United States Patent
Chen et al.

(10) Patent No.: US 11,780,226 B2
(45) Date of Patent: Oct. 10, 2023

(54) FLUID EJECTION DEVICES

(71) Applicant: Hewlett-Packard Development Company, L.P., Spring, TX (US)

(72) Inventors: Chien-Hua Chen, Corvallis, OR (US); Michael G. Groh, Corvallis, OR (US); Bo Song, Corvallis, OR (US); Veronica Frances Burnett Krim, Corvallis, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 184 days.

(21) Appl. No.: 17/230,053

(22) Filed: Apr. 14, 2021

(65) Prior Publication Data

US 2021/0276332 A1 Sep. 9, 2021

Related U.S. Application Data

(63) Continuation-in-part of application No. PCT/US2019/044178, filed on Jul. 30, 2019.

(51) Int. Cl.
*B41J 2/16* (2006.01)
*B41J 2/14* (2006.01)

(52) U.S. Cl.
CPC ..... *B41J 2/1606* (2013.01); *B41J 2/1433* (2013.01); *B41J 2002/14475* (2013.01)

(58) Field of Classification Search
CPC ..... B41J 2/1606; B41J 2/1443; B41J 2/1433
See application file for complete search history.

(56) References Cited

U.S. PATENT DOCUMENTS

| | | | | |
|---|---|---|---|---|
| 5,148,193 | A | 9/1992 | Inamoto et al. | |
| 5,212,496 | A | 5/1993 | Badesha et al. | |
| 5,230,926 | A | 7/1993 | Narang et al. | |
| 5,502,470 | A | 3/1996 | Miyashita et al. | |
| 5,759,421 | A | 6/1998 | Takemoto et al. | |
| 5,902,704 | A | 5/1999 | Schoenborn et al. | |
| 6,042,219 | A * | 3/2000 | Higashino | B41J 2/2128 347/45 |
| 6,151,045 | A | 11/2000 | Beach et al. | |
| 6,179,978 | B1 | 1/2001 | Hirsch et al. | |
| 6,312,103 | B1 | 11/2001 | Haluzak | |
| 6,737,109 | B2 | 5/2004 | Stanton et al. | |
| 7,594,718 | B2 | 9/2009 | Soutar et al. | |
| 8,042,908 | B2 | 10/2011 | Clark et al. | |
| 8,632,162 | B2 | 1/2014 | Vaeth et al. | |
| 8,690,288 | B2 | 4/2014 | Gumina | |
| 8,851,630 | B2 | 10/2014 | Sambhy et al. | |
| 8,991,954 | B2 | 3/2015 | Govyadinov et al. | |
| 9,044,943 | B2 | 6/2015 | Chang et al. | |

(Continued)

FOREIGN PATENT DOCUMENTS

| | | | |
|---|---|---|---|
| CN | 1942317 | A | 4/2007 |
| CN | 1970300 | A | 5/2007 |

(Continued)

*Primary Examiner* — Jason S Uhlenhake
(74) *Attorney, Agent, or Firm* — Foley & Lardner LLP

(57) ABSTRACT

A fluid ejection device can include a nozzle plate incorporating a non-coplanar surface. The non-coplanar surface can include a hydrophilic region of a hydrophilic material having a water contact angle from about 50° to about 90° and a hydrophobic coating including a hydrophobic material having a water contact angle from about 91° to about 160°.

13 Claims, 2 Drawing Sheets

(56) References Cited

U.S. PATENT DOCUMENTS

| | | | | |
|---|---|---|---|---|
| 9,073,323 | B2 | 7/2015 | Sambhy et al. | |
| 9,221,247 | B2 | 12/2015 | Cruz-Uribe et al. | |
| 9,855,566 | B1 * | 1/2018 | Craft | B41J 2/1645 |
| 10,015,887 | B2 | 7/2018 | Zenou et al. | |
| 2001/0044030 | A1 | 11/2001 | Veerasamy et al. | |
| 2002/0000169 | A1 * | 1/2002 | Suda | B41C 1/1066 101/463.1 |
| 2003/0020785 | A1 * | 1/2003 | Andrews | B41J 2/1606 347/47 |
| 2003/0210299 | A1 | 11/2003 | Min et al. | |
| 2004/0231780 | A1 | 11/2004 | Clark et al. | |
| 2004/0246291 | A1 | 12/2004 | Kinpara | |
| 2005/0012781 | A1 | 1/2005 | Miura et al. | |
| 2005/0068367 | A1 | 3/2005 | Kato et al. | |
| 2005/0243129 | A1 * | 11/2005 | Kim | B41J 2/162 347/45 |
| 2007/0184193 | A1 * | 8/2007 | Cha | B41J 2/1433 427/272 |
| 2008/0136868 | A1 | 6/2008 | Lebens | |
| 2008/0225083 | A1 * | 9/2008 | McAvoy | B41J 2/1628 347/47 |
| 2008/0284810 | A1 | 11/2008 | Shimizu et al. | |
| 2009/0085972 | A1 * | 4/2009 | Sim | B41J 2/1623 216/27 |
| 2009/0186293 | A1 | 7/2009 | Fannin et al. | |
| 2010/0315463 | A1 | 12/2010 | Escude et al. | |
| 2013/0216738 | A1 | 8/2013 | Owusu et al. | |
| 2016/0203973 | A1 | 7/2016 | Di et al. | |
| 2017/0182778 | A1 | 6/2017 | Cattaneo et al. | |

FOREIGN PATENT DOCUMENTS

| | | | |
|---|---|---|---|
| CN | 101557939 | A | 10/2009 |
| CN | 104245343 | A | 12/2014 |
| CN | 104253089 | A | 12/2014 |
| CN | 105711258 | A | 6/2016 |
| CN | 107953672 | A | 4/2018 |
| CN | 109910435 | A | 6/2019 |
| EP | 0568248 | | 11/1993 |
| JP | 63-239063 | A | 10/1988 |
| JP | 08-252919 | A | 10/1996 |
| JP | 2000117977 | | 4/2000 |
| JP | 2007058187 | | 3/2007 |
| JP | 2011-161903 | A | 8/2011 |
| JP | 2018-199318 | A | 12/2018 |
| MX | 2017012076 | | 9/2018 |
| TW | 200523126 4 | | 7/2005 |
| TW | 201103758 | A | 2/2011 |
| WO | 97/35724 | A1 | 10/1997 |
| WO | 03041963 | | 5/2003 |
| WO | 2014136440 | | 9/2014 |
| WO | 2016157715 | | 10/2016 |
| WO | 2017/050808 | A1 | 3/2017 |
| WO | 2019/110591 | A1 | 6/2019 |

* cited by examiner

FLUID EJECTION DEVICES

The present application is a continuation in part application of PCT/US2019/044178, filed on Jul. 30, 2019, which is incorporated herein by reference in its entirety.

BACKGROUND

Fluid ejection devices are utilized to print ink or other material onto a surface and may include multiple nozzles via which the ink or the other material may be dispensed. Characteristics of a surface of the nozzle plate around the ejection port of a nozzle can affect performance of the fluid ejection device.

DETAILED DESCRIPTION

Figure 1:
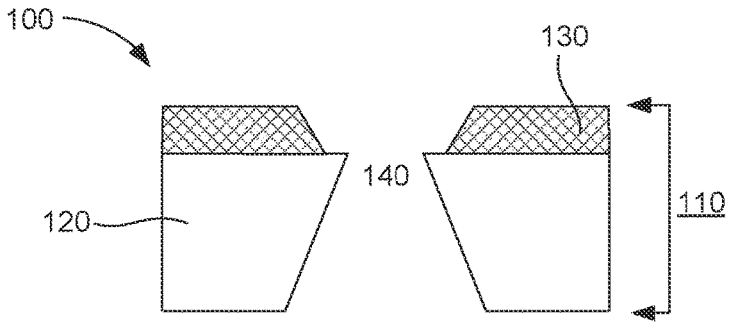
FIG. 1 graphically illustrates an example fluid ejection device in accordance with the present disclosure.

In accordance with examples of the present disclosure, a fluid ejection device ("device") can include a nozzle plate incorporating a non-coplanar surface. The non-coplanar surface can include a hydrophilic region of a hydrophilic material having a water contact angle from about 50° to about 90° and a hydrophobic coating including a hydrophobic material having a water contact angle from about 91° to about 160°. In one example, a differential between the water contact angle of the hydrophilic material and the water contact angle of the hydrophobic material can be from about 20° to about 110°. In another example, the hydrophilic material can be selected from an epoxy-based photoresist, bisbenzoxyxlobutene, polyimide, piperonyl butoxide, epoxy, or a combination thereof. In yet another example, the hydrophobic material can be selected from fluoropolymers, fluoroalkylsilanes, polysiloxanes, nanoceramics, acrylic, or a combination thereof. In a further example, a thickness of the hydrophobic coating can range from about 10 nm to about 20 μm. In an example, the hydrophilic region can define an opening of an ejection port and the hydrophobic coating can be located outside of and around the opening providing a counter bore on the nozzle plate of the fluid ejection device. In another example, the hydrophilic region can define a floor surface of a channel on the nozzle plate and the hydrophobic coating can define a sidewall surface of the channel providing an ink puddle control structure on the nozzle plate of the fluid ejection device. In yet another example, the hydrophilic region can define a floor surface and the hydrophobic coating can define a sidewall surface providing a shipping tape adhesion area of the fluid ejection device.

In another example, a method of manufacturing a fluid ejection device ("method") can include adhering a hydrophobic coating including a hydrophobic material having a water contact angle from about 91° to about 160° onto a nozzle plate of a fluid ejection device, where the nozzle plate includes a hydrophilic material having a water contact angle from about 50° to about 90°; and forming a non-coplanar surface relative to the hydrophobic coating, the non-coplanar surface having a hydrophilic region of hydrophilic material. In one example, the forming of the non-coplanar surface can include adhering a hydrophobic coating at a smaller surface area than a surface area of a surface of the nozzle plate of the hydrophilic material. In another example, the forming of the non-coplanar surface can include a subtractive process and the subtractive process can include partial removal of the hydrophobic coating by laser ablation using a laser having a wavelength ranging from about 10 nm to about 20 μm to remove a portion of the hydrophobic material. In yet another example, the forming of the non-coplanar surface can be a subtractive process and the subtractive process can include partially removing the hydrophobic coating by applying a photoresist mask over a selected area of the hydrophobic material to be removed, exposing the nozzle plate to ultraviolet radiation, where an unmasked area of the hydrophobic material becomes cross-linked at the exposed area following exposure to the ultraviolet radiation, and removing the photoresist mask and uncross-linked hydrophobic material. In another example, the method can further include pressing a layer of material from a transfer film against a coating of the non-coplanar surface of the fluid ejection device, thereby causing portions of the material pressed from the transfer film to adhere to the coating forming a layer of the material over the coating, wherein the material is selected from a non-sticking coating, a lubricant, an anti-graffiti coating, a hydrophobic coating, or a combination thereof.

In another example, a fluid ejection system ("system") can include a fluid ejection device and a fluid reservoir. The fluid ejection device can include a nozzle plate with a non-coplanar surface having a hydrophilic region of hydrophilic material having a water contact angle from about 50° to about 90° and a hydrophobic coating including a hydrophobic material having a water contact angle from about 91° to about 160°. The fluid reservoir can be fluidly coupled to a firing chamber of the fluid ejection device, wherein the fluid reservoir can be loaded or loadable with an ink composition. In one example, the hydrophilic region can define an opening of an ejection port and the hydrophobic coating can be located outside of and around the opening of the ejection portion and can define a sidewall surface of the channel on the surface of the nozzle plate.

It is noted that when discussing the fluid ejection device, the method of manufacturing the fluid ejection device, and/or the fluid ejection system herein, these discussions can be considered applicable to one another whether or not they are explicitly discussed in the context of that example. Thus, for example, when discussing a hydrophilic material, such disclosure is also relevant to and directly supported in the context of the fluid ejection device, the method of manufacturing the fluid ejection device, the fluid ejection system, and vice versa.

It is also understood that terms used herein will take on the ordinary meaning in the relevant technical field unless specified otherwise. In some instances, there are terms defined more specifically throughout the specification or included at the end of the present specification, and thus, these terms can have a meaning as described herein.

Fluid Ejection Devices

A fluid ejection device 100 as illustrated in FIG. 1, can include a nozzle plate 110 incorporating a non-coplanar surface. The non-coplanar surface can include a hydrophilic region 120 of a hydrophilic material having a water contact angle from about 50° to about 90° and a hydrophobic coating 130 including a hydrophobic material having a water contact angle from about 91° to about 160°. In one example, a differential between the water contact angle of the hydrophilic material and the water contact angle of the hydrophobic coating can be from about 20° to about 110°. As illustrated in FIG. 1, in a cross-sectional view, the nozzle plate can include an opening for an ejection port 140, upon which the ink or other material may be dispensed.

The nozzle plate utilized in fluid ejection devices may be exposed to harsh thermal, chemical, and/or mechanical stresses. Accordingly, the nozzle plate can include a nozzle plate substrate that can include a material that can withstand repeated exposure to these stresses. The nozzle plate substrate can be selected from thin metal films, SU-8 commercially available from Kayaku Advanced Materials® Inc., USA; bisbenzocyclobutene; AR-N 4600 (Atlas 46) commercially available from Allresist GmbH, Germany; MEGAPOSIT™ SPR™ 220 commercially available from Rohm and Haas Electronic Materials, LLC, USA; or a combination thereof. The nozzle plate substrate may have a thickness that can range from about 5 μm to about 60 μm. In yet other examples, the nozzle plate substrate can have a thickness that can range from about 5 μm to about 30 μm, from about 6 μm to about 15 μm, from about 12 μm to about 22 μm, from about 20 μm to about 30 μm, from about 15 μm to about 45 μm, or from about 30 μm to about 60 μm.

In some examples, the nozzle plate substrate may include the hydrophilic material. In yet other examples, the nozzle plate may be coated with the hydrophilic material to form the hydrophilic region. The hydrophilic region can be located in an area where an aqueous fluid may be intended to flow freely and can be located to direct fluid flow. The hydrophilic material, in an example, can be selected from an epoxy, epoxy-based negative photoresist, silica, fused silica, silicon, quartz, glass, bisbenzoxyxlobutene, polyimide, piperonyl butoxide, poystryrene, polycarbonate, polymethyl methacrylate, polyethylene glycol, polyethylene glycol diacrylate, polyfluoropolyether diol methacrylate, perfluoropolyethylene-polyethylene glycol blend, polyurethane, cyclic-olefin copolymers, copolymers, or combinations thereof. In yet another example, the hydrophilic material can be selected from an epoxy based negative photoresist, bisbenzoxyxlobutene, polyimide, piperonyl butoxide, epoxy, or a combination thereof. In a further example, the hydrophilic material can include an epoxy based negative photoresist such as SU-8 commercially available from Kayaku Advanced Materials® Inc., USA; Hare SQ™ commercially available from KemLab, USA; or the like. The hydrophilic material can have a thickness of from about 5 μm to about 60 μm, from about 5 μm to about 20 μm, from about 15 μm to about 30 μm, from about 15 μm to about 45 μm, or from about 30 μm, to about 60 μm.

The hydrophilic material can have a water contact angle at a surface thereof that can range from about 50° to about 90°, from about 60° to about 80°, from about 70° to about 90°, from about 70° to about 80°, from about 80° to about 90°, or from about 75° to about 85°. The water contact angle may be measured by an optical tensiometer. The optical tensiometer can dispense a 0.1 μL water drop on a layer of the hydrophilic material, a digital camera can take an image of the droplet on the surface, and the contact angle of the droplet with respect to the surface of the hydrophilic material can be digitally measured. A water contact angle can be measured according to ASTM D7334 standard.

The hydrophilic material can also have an ink contact angle at a surface thereof that can range from about 2° to about 10°, from about 5° to about 12°, from about 10° to about 15°, from about 15° to about 20°, or from about 20° to about 25°. The ink contact angle can be measured by an optical tensiometer. The optical tensiometer can dispense a 0.1 μL drop of a latex ink, commercially available as HP® 792 Latex Magenta or HP® 831 Latex series, on a layer of the hydrophilic material, a digital camera can take an image of the droplet on the surface, and the contact angle of the droplet with respect to the surface of the hydrophilic material can be digitally measured.

The nozzle plate can further include a hydrophobic coating that can include a hydrophobic material. The hydrophobic material may be selected from fluoropolymers, fluoroalkylsilanes, polysiloxanes, nanoceramics, acrylic, or a combination thereof. Example fluoropolymers can include fluoroether, fluoroether acrylate, fluoroacrylate, pefluoroether, fluoroalkylsilane, polytetrafluoroethylene, or the like. Example nanoceramics can include hydrocarbons, ceramic hydrocarbon, fluorocarbons, polysiloxanes, polysiloxanes including silicon oxide, polysiloxanes including titanium oxide, or a combination thereof.

In some examples, the hydrophobic material can be a photo-definable material. Photo-definable hydrophobic materials can include SU8 with from about 0.05 wt % to about 1 wt % BYK-333 admixed thereto. The photo-definable nature of these materials can permit high resolution of the hydrophobic material when applied to a surface of the nozzle plate. In an example, a photo-definable hydrophobic material can have a photo-definable resolution of from about 0.1 μm to about 10 μm, from about 0.1 μm to about 5 μm, from about 5 μm to about 10 μm, from about 0.5 μm to about 2.5 μm, from about 2.5 μm to about 7.5 μm, or from about 1 μm to about 3 μm.

A thickness of the hydrophobic coating of the hydrophobic material can range from about 10 nm to about 20 μm. In yet another example, a thickness of the hydrophobic coating can range from about 10 nm to about 100 nm, from about 10 nm to about 1,000 nm, from about 250 nm to about 750 nm, from about 1 μm to about 10 μm, from about 5 μm to about 15 μm, or from about 10 μm to about 20 μm.

The hydrophobic material can have a water contact angle at a surface thereof that can range from about 91° to about 160°, from about 100° to about 150°, from about 91° to about 130°, from about 120° to about 160°, from about 130° to about 150°, or from about 91° to about 140°. The water contact angle may be measured as indicated above.

The hydrophobic material can also have an ink contact angle at a surface thereof that can range from about 35° to about 45°, from about 25° to about 35°, from about 40° to about 50°, from about 50° to about 60°, or from about 60° to about 90°. The ink contact angle can be measured as indicated above.

Incorporating both a hydrophilic material and a hydrophobic material can provide different surface tensions in differing areas of the nozzle plate. Aqueous fluids may flow with ease in areas including the hydrophilic material, while aqueous fluid may be repealed in areas including the hydrophobic material. Therefore, aqueous fluids may require greater force to flow into and through areas including the hydrophobic material and fluid flow can be directed based on a location of the hydrophilic material and the hydrophobic material on the nozzle plate. A differential between the water contact angle of the hydrophilic material and the water contact angle of the hydrophobic material can range from about 20° to about 110°, from about 20° to about 80°, from about 50° to about 100°, or from about 25° to about 75°. The greater the differential between a water contact angle of the hydrophilic material and the hydrophobic material, the greater the repulsion in areas that include the hydrophobic material can be.

Figure 2:
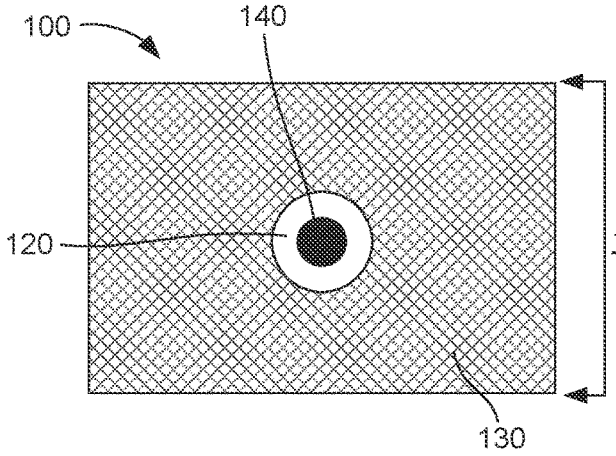
FIG. 2 graphically illustrates an example fluid ejection device in accordance with the present disclosure.

In an example, the hydrophilic region can define an opening of an ejection port and the hydrophobic coating can be located outside of and around the opening providing a counter bore (a recess) on the nozzle plate of the fluid ejection device, as illustrated in a top view of the ejection nozzle of a fluid ejection device 100, as shown in FIG. 2. The hydrophobic material can prevent ink puddling and drooling at the ejection port, while the hydrophilic composition can allow ink to flow freely through the ejection port. In addition, the hydrophobic coating can prevent ink caking at the fluid ejection device thereby reducing printhead damage.

Figure 3:
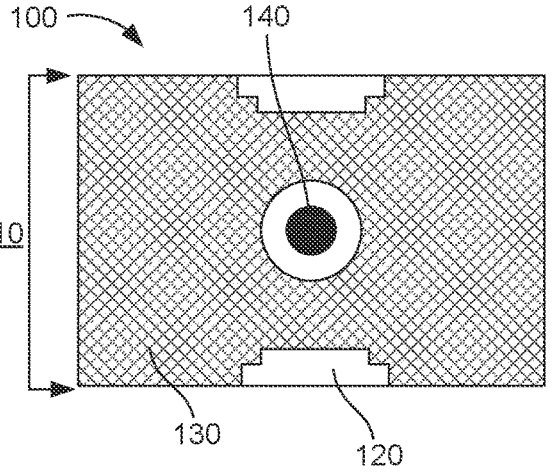
FIG. 3 graphically illustrates an example fluid ejection device in accordance with the present disclosure.
Figure 4:
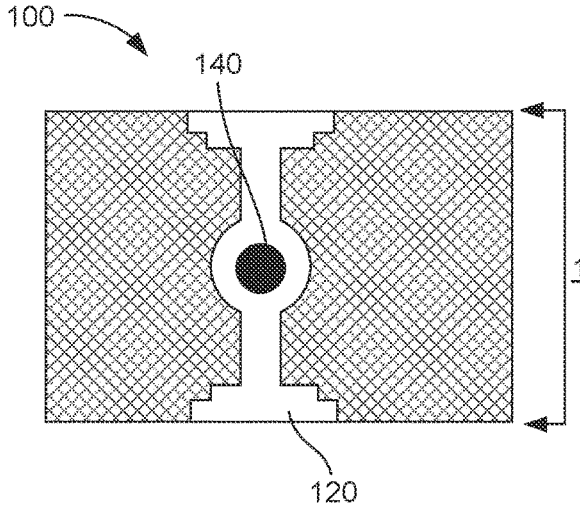
FIG. 4 graphically illustrates an example fluid ejection device in accordance with the present disclosure.

In another example, as illustrated in a top view in FIGS. 3 and 4 of the fluid ejection device 100, the hydrophilic region 120 including the hydrophilic material can include a floor surface of a channel on the nozzle plate 110 and the hydrophobic coating can define a sidewall surface of the channel providing an ink puddle control structure on the nozzle plate of the fluid ejection device. Ink puddle control structures can serve as drainage channels within a fluid ejection device surface. The drainage channels can pull ink away from an ejection nozzle. In some examples, the hydrophilic region can be wider in cross-section in an area further from the ejection port and thinner in cross-section in an area closer to the ejection port, as illustrated in FIG. 3. The widening can further permit draining of ink away from the ejection nozzle. In some examples, as illustrated in FIG. 4, the ink puddle control structure of the hydrophilic region can be separated from an area of the ejection nozzle by the hydrophobic coating.

Figure 5:
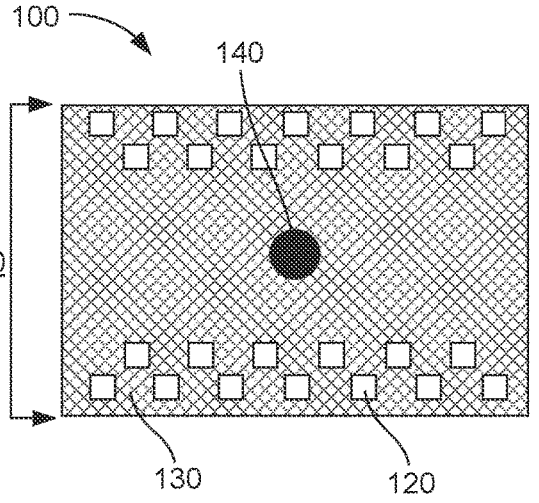
FIG. 5 graphically illustrates an example fluid ejection device in accordance with the present disclosure.

In yet another example, the hydrophilic region 120 can define a floor surface and the hydrophobic coating 130 can define a sidewall surface providing a shipping tape adhesion area of the fluid ejection device 100, as illustrated in a top view in FIG. 5. The shipping tape adhesion area can have a cross-hatch interlocking design, in some examples. A varying topography in this area can allow heat shrinking shipping tape to adhere to the area; thereby, providing an increase in an overall strength of the adhesion of the shipping tape.

Examples of fluid ejection devices can include inkjet printing devices, devices used with sensors, MEMS fluid ejectors, fluid ejectors for 3D printing, etc. Thus, the fluid ejection devices can be used to eject any of a number of fluids including traditional inkjet inks or other fluids. In these examples, the fluid ejection device can include a substrate and support other structures, and/or can also be used to channel ink or other fluid into a channel for ejection through an opening or orifice of nozzle plate. In this example, the fluid can be ejected through the opening (or multiple openings) of the nozzle plate by the use of a resister or other jetting structure, e.g., piezo, thermal, etc., just below the opening. When the resister acts upon the fluid, it can be ejected as a small droplet through the opening.

In some examples, the fluid ejection device can further include a firing chamber which can include sidewalls and a floor that can be attached to the nozzle plate. The firing chamber may include the same materials discussed above with respect to the nozzle plate. The floor of the firing chamber may house a resistor, a piezoelectric element, or other electronics that can generate a bubble of a fluid when positioned therein. The expansion of the bubble can cause a drop of ink to be ejected through an opening in the nozzle plate. A pressure from the bubble formation may cause a fluid within the firing chamber to eject through a hole in the nozzle plate. Fluid ejection devices can be configured to print varying drop sizes of ink such as less than 10 picoliters, less than 20 picoliters, less than 30 picoliters, less than 40 picoliters, less than 50 picoliters, etc.

Methods of Manufacturing Fluid Ejection Devices

Figure 6:
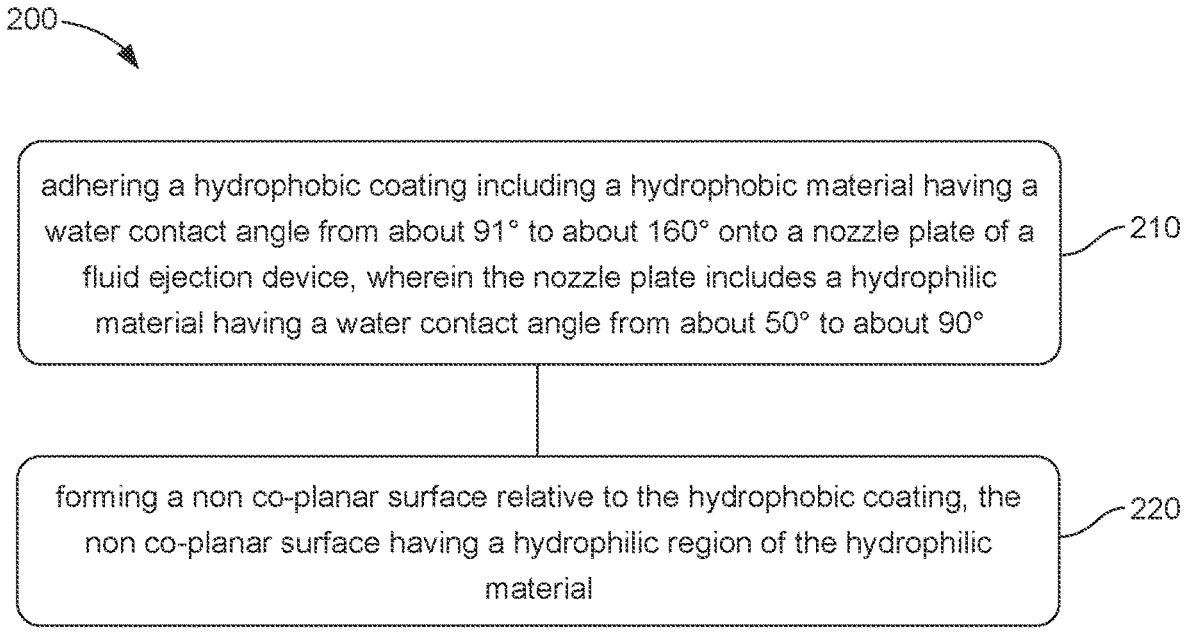
FIG. 6 is a flow diagram of an example method of manufacturing a fluid ejection device, in accordance with the present disclosure.

Also presented herein, as illustrated in FIG. 6, is a method of manufacturing a fluid ejection device. The method 200, can include adhering 210 a hydrophobic coating including a hydrophobic material having a contact angle from about 91° to about 160° onto a nozzle plate of a fluid ejection device, wherein the nozzle plate can include a hydrophilic material having a water contact angle from about 50° to about 90°. The method can further include forming 220 a non-coplanar surface relative to the hydrophobic coating. The non-coplanar surface can have a hydrophilic region of the hydrophilic material. The hydrophilic material and the hydrophobic material can be as described above.

In an example, the adhering can include applying a hydrophobic coating at a smaller surface area than a surface area of a surface of the nozzle plate including the hydrophilic material. Accordingly, the adhering and the forming of the non-coplanar surface can occur simultaneously. For example, the adhering can occur by transferring the hydrophobic material from a transfer film onto a surface of the fluid ejection device. A transfer film, such as a polymer film, can be coated with a layer of the hydrophobic material. The transfer film can then press the hydrophobic material side down against a surface of the nozzle plate that will be coated with the hydrophobic material. The pressing can sandwich the hydrophobic material between the transfer film and the nozzle plate or a hydrophilic coating thereon. The transfer process may be carried out using a stamp or roller over a film such as polyethylene terephthalate (PET). Other examples involve polydimethylsiloxane (PDMS) stamps over a film such as polyethylene (PE). A pressure roller may be lowered to push the transfer film downward such that the hydrophobic material contacts a surface of the nozzle plate that may be intended to receive the hydrophobic material as the stamp or pressure roller passes over the surface. The pressure applied may range from about 1 psi to about 100 psi, from about 10 psi to about 30 psi, from about 1 psi to about 10 psi, or from about 20 psi to about 100 psi for a period of time ranging from about 1 second to about 30 seconds, from about 1 second to about 5 seconds, from about 2 seconds to about 10 seconds, or from about 10 seconds to about 30 seconds. Portions of the hydrophobic material can be caused to adhere onto the surface. In some examples, the hydrophobic material can also be caused to adhere onto overlapping edges of the surface at the openings of the nozzle plate due to the pressure. The transfer film may then be removed and a thickness of the hydrophobic material that was pressed onto the surface may remain adhered to the surface. Once the material has been applied, the layer of the hydrophobic material transferred to the surface may be cured by application of ultraviolet light, heat, or other manipulation, if the hydrophobic material can be cured.

The adhering can occur to a smaller surface area than a surface area of a surface of the nozzle plate. Accordingly, the adhering and the forming of the non-coplanar surface can occur simultaneously. For example, the adhering can include coating the transfer film with less surface area than a surface area of the nozzle plate, by applying a transfer film that may be smaller in surface area than a surface area of the nozzle plate, or by using a vacuum as described in further detail below. In yet other examples, the adhering may be to an entire surface of the nozzle plate by coating a transfer film that may be as large or larger than the surface area of the nozzle plate.

A total thickness of a layer of the hydrophobic pressed onto the surface and adhered to the surface may be less than a thickness of the layer on the transfer film. A remaining thickness of the hydrophobic material may be removed upon removal of the transfer film. In some examples, portions of the layer may be caused to adhere onto the surface and overlapping edges of the surface at the openings can be about half the thickness of the layer of the hydrophobic material on the transfer film. A uniform thickness may be adhered by coating the layer of the hydrophobic material on the transfer film at a thickness that may be twice the uniform thickness. Half of the thickness of the layer of material may be caused to adhere to the surface of the fluid ejection device via the application and subsequent removal of the transfer film. Where characteristics of the transfer film, material transferred, and/or surface of the nozzle plate affect the amount of hydrophobic material transferred such that the amount transferred can be an amount different than half, then the thickness of the material on the transfer film may be adjusted accordingly to achieve a desired final thickness.

In some examples, the transfer film adhesion method can include a continuous web having the layer of the hydrophobic material thereon. The continuous web of transfer film may be advanced to align with an area of the nozzle plate. After the continuous web of transfer film has been advanced, the portion of the layer of material from the continuous web or transfer film may be removed and adhered to the nozzle plate. In some examples, the adhering of the continuous web or the transfer film may be drawn by a vacuum to conform to the underlying surface. This may result in the transfer film and hydrophobic material protruding below the rest of the film. Once the transfer film with the hydrophobic material thereon has adhered to the shape of the vacuum head, the vacuum head may be lowered while maintaining the vacuum so that the portions of the transfer film at the protrusions contact a surface of the fluid ejection device. This transfers a portion of the hydrophobic material onto a surface of the fluid ejection device at a uniform thickness. After transfer, the vacuum head may be raised, the vacuum released and the transfer film advanced past the vacuum head for a subsequent application.

In yet other applications, the adhesion of a hydrophobic material to portions of a surface of the nozzle plate to form a non-coplanar surface can include applying a layer of the hydrophobic material and adhering said layer with an adhesive. The adhesive may depend on the hydrophilic material and hydrophobic material. However, example adhesives can include an epoxy adhesive, a silicone adhesive, an acrylic adhesive, or a combination thereof. Once the adhesive is applied, the hydrophobic material layer can be pressed. The pressure applied may range from about 1 psi to about 100 psi, from about 10 psi to about 30 psi, from about 1 psi to about 10 psi, or from about 20 psi to about 100 psi and can be applied for a period of time ranging from about 1 second to about 30 seconds, from about 1 second to about 5 seconds, from about 2 seconds to about 10 seconds, from about 10 seconds to about 30 about 30 seconds, from about 5 seconds to about 25 seconds, or from about 15 seconds to about 30 seconds.

In yet other examples, the adhesion can include covering an entire surface of the nozzle plate with the hydrophobic material. In one example, the adhering can include applying the hydrophobic material by spin coating or dry film laminating of the hydrophobic material onto the surface. Spin coating can include depositing an amount of the hydrophobic material over a hydrophilic material of the nozzle plate followed by rotating the nozzle plate to dispense the hydrophobic material via centrifugal force over a surface of the hydrophilic material. An amount of the hydrophobic material deposited can vary based on a desired thickness of the hydrophobic material. In one example, the spin coating may occur at from about 500 rpms to about 3,000 rpms for about 15 seconds to about 60 seconds. In yet other examples, the spin coating may occur at from about 500 rpms to about 2,500 rpms, from about 1,000 rpms to about 3,000 rpms, from about 1,500 rpms to about 3,000 rpms, or from about 2,000 rpms to about 3,000 rpms. In further examples, the spin coating may occur from about 15 seconds to about 45 seconds, from about 15 seconds to about 30 seconds, from about 30 seconds to about 45 seconds, from about 30 seconds to about 60 seconds, or from about 20 seconds to about 40 seconds.

Dry film laminating of the hydrophobic material onto a hydrophilic material of the nozzle plate can occur at a temperature ranging from about 70° C. to about 100° C. and a pressure ranging from about 10 psi to about 50 psi. In some examples, the temperature can range from about 70° C. to about 90° C., from about 80° C. to about 100° C., or from about 75° C. to about 95° C. In some examples, the pressure can range from about 10 psi to about 30 psi, from about 25 psi to about 50 psi, from about 20 psi to about 40 psi, or from about 30 psi to about 50 psi. The temperature and pressure can vary depending on a thickness of the hydrophobic material being applied.

Following application, a portion of the hydrophobic material may be selectively removed by a subtractive process to form the non-coplanar surface relative to the hydrophobic coating. The subtractive process can include partial removal of the hydrophobic coating by laser ablation, by applying a photoresist mask, or a combination thereof.

Laser ablation can include using a laser to selectively remove a portion of the hydrophobic material. The laser may be a solid state, gas, excimer, dye, or semiconductor laser and may have a wavelength ranging from about 248 nm to about 10.6 μm, from about 248 nm to about 500 nm, from about 250 nm to about 750 nm, from about 500 nm to about 1 μm, from about 1 μm to about 10.6 μm, or from about 750 nm to about 10.6 μm. The laser may be applied to selectively remove a portion of the hydrophobic material. The laser can remove the hydrophobic material by vaporizing the hydrophobic material in the area where the laser was applied.

Selective removal via a photoresist mask can include applying a photoresist mask over a selected area of the hydrophobic material. The photoresist mask may include an opaque plate with holes or transparent sections that can allow ultraviolet radiation to pass through the photoresist mask in a defined pattern. The photoresist mask can be a template which can include openings where the hydrophobic material may remain or may be removed. Whether or not the openings align with portions to remain or to be removed may depend on the photoresist of the hydrophobic material. If the photoresist is a positive photoresist, then the portion of the polymeric photoresist exposed to ultraviolet radiation may become soluble to a photoresist developer where the unexposed portion remains insoluble. If the polymeric photoresist is a negative photoresist, then the portion of the polymeric photoresist exposed to ultraviolet radiation cross-links and becomes insoluble to a photoresist developer, whereas the unexposed portions can be removed by the photoresist developer. The photoresist mask may include fused silica covered with an opaque film, glass covered with an opaque film, silicon and molybdenum, or the like.

Once the photoresist mask is applied over the hydrophobic material, the fluid ejection device can be exposed to ultraviolet radiation. The exposure can vary depending on the photoresist. In some examples, the ultraviolet radiation can have a wavelength ranging from about 100 nm to about 450 nm, from about 100 nm to about 280 nm, from about 280 nm to about 315 nm, from about 315 nm to about 400 nm, from about 100 nm to about 300 nm, or from about 200 nm to about 450 nm. The exposure time frame can range from about 30 seconds to about 1 hour, from about 5 minutes to about 45 minutes, or from about 30 minutes to about 1 hour. A portion of the hydrophobic material may become cross-linked following exposure to the ultraviolet radiation.

Following exposure to ultraviolet radiation, the photoresist mask and uncross-linked portions of the hydrophobic material can be removed. In some examples, a photoresist developer can be applied to remove portions of the hydrophobic material that may not be crosslinked. The photoresist developer will vary depending on the polymeric photoresist in the hydrophobic material.

In some examples, the method can further include baking the fluid ejection device after exposing it to ultraviolet radiation to cure the crosslinked hydrophobic material. The baking can include a soft bake and/or a curing bake. A post exposure bake (PEB) can occur when multiple photoresist masks may be applied in order to form a layer of the photo-definable hydrophobic material with depth variations. A post exposure baking can include baking at a temperature ranging from about 70° C. to about 120° C., from about 80° C. to about 100° C., from about 70° C. to about 90° C., or from about 100° C. to about 120° C. Post exposure baking can occur for a period of time ranging from about 30 seconds to about 10 minutes, from about 2 minutes to about 8 minutes, from about 1 minute to about 5 minutes, or from about 5 minutes to about 10 minutes. A curing bake can be a final bake. The curing bake can occur at from about 150° C. to about 200° C., from about 150° C. to about 175° C., from about 160° C. to about 180° C., or from about 180° C. to about 200° C. The curing bake can occur for a period of time ranging from about 15 minutes to about 1 hour, from about 15 minutes to about 45 minutes, from about 15 minutes to about 30 minutes, or from about 30 minutes to about 1 hour.

In some examples, when the hydrophobic material on the nozzle plate includes depth variations, applying the photoresist mask and exposing the nozzle plate to the ultraviolet radiation may be repeated. The method can include applying a first photoresist mask, exposing the nozzle plate to the ultraviolet radiation, and post exposure baking at from about 70° C. to about 120° C. for a period of time of about 30 seconds to about 10 minutes. Following the first application, exposure, and post exposure baking, a second photoresist mask smaller than the first photoresist mask can be applied. The fluid ejection device can then be exposed to the ultraviolet radiation, and an additional baking of the nozzle plate can occur at from about 150° C. to about 200° C. for a period of time of about 15 minutes to about 1 hour.

A multi-step photoresist process may include masking, exposure, baking, etc., and can be used to form a counterbore around the ejection port of the nozzle plate of a fluid ejection device. In some examples, the counterbore can have a tapered shape. Tapering can occur by incorporating a lower exposure time during the first photoresist mask, post exposure baking at lower temperatures, and for less periods of time, or combinations thereof. As used, "lower exposure time," "lower temperatures," and "less periods of time" indicate the bottom end of the ranges discussed above. Accordingly, a portion of the photo-definable hydrophobic material exposed near an exterior surface may be processed, while an interior most portion (adjacent or near the hydrophilic material) may not be processed; thereby, permitting widening during development of the interior most portion of the hydrophobic material.

In some examples, the method can further include adhering a hydrophilic material to a surface of a nozzle plate prior to adhering the hydrophobic coating thereon. The adhering of the hydrophilic material can occur by any of the methods previously discussed above with respect to the hydrophobic material of the hydrophobic coating. In some examples, a counterbore can be formed in the hydrophilic material prior to adhering the hydrophobic coating. The counterbore may be formed by selectively applying a hydrophilic material that does not cover an entire surface of the nozzle plate. In yet other examples, the counterbore may be formed by selectively subtracting a portion of the hydrophilic material. The selectively subtracting can include partial removal of the hydrophilic material by laser ablation, by applying a photoresist mask, or a combination thereof. The selectively subtracting may occur as described above and may occur prior to adhering the hydrophobic coating.

In yet other examples, the method can further include pressing a layer of material from a transfer film against a coating of the non-coplanar surface of the fluid ejection device. The pressing can cause portions of the material pressed from the transfer film to adhere to the coating thereby forming a layer of the material over the coating. In some examples, the coating can be the hydrophilic material. The material may be selected from a non-sticking coating, a lubricant, anti-graffiti coating, hydrophobic coating, or a combination thereof. The pressing can be applied via the transfer film or continuous web. A non-sticking coating can be applied to reduce print head servicing frequency, such as to mitigate crusting, and improve the printer up time. A lubricant coating can be used to reduce friction from interactions between the fluid ejection device and a wiper/print media. Accordingly, a coating having properties or a combination of properties may address various issues such as puddling by using a low surface energy coating (wider ink space), frequent print head servicing by using a non-sticking/sacrificial coating, and print head damage by using a lubricating coating.

Fluid Ejection Systems

Figure 7:
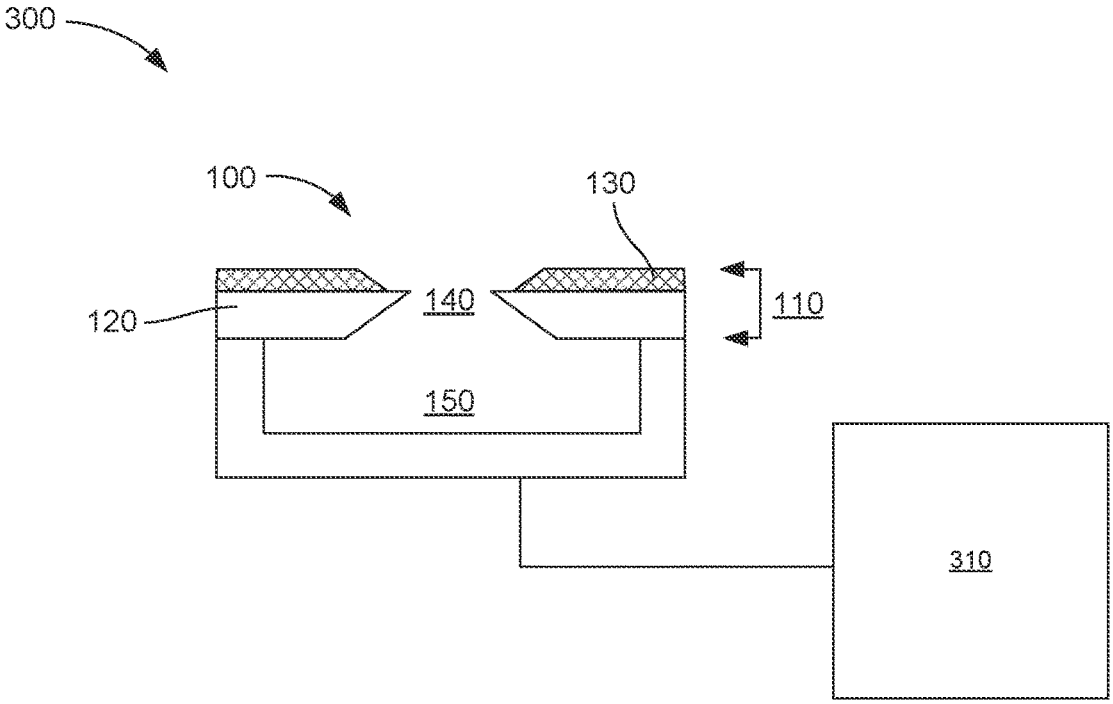
FIG. 7 graphically illustrates an example fluid ejection system in accordance with the present disclosure

Further presented herein is a fluid ejection system 30000, as illustrated in the cross-sectional view in FIG. 7. The fluid ejection system can include a fluid ejection device 100 and a fluid reservoir 310. The fluid ejection device 100 can include a nozzle plate 110 with a non-coplanar surface having a hydrophilic region 120 of hydrophilic material having a water contact angle from about 50° to about 90° and a hydrophobic coating 130 including a hydrophobic material having a water contact angle from about 91° to about 160°. The fluid ejection device may be as described above. The fluid ejection system can further include a fluid reservoir. The fluid reservoir can be fluidly coupled or couplable to a firing chamber 150 of the fluid ejection device. The fluid reservoir may be loaded or loadable with an ink composition. The fluid reservoir may be in fluid communication with the firing chamber and may be filled or fillable with ink.

Based upon the above discussion and illustrations, various modifications and changes may be made to the various examples without strictly following those illustrated and described herein. For example, methods as exemplified may involve actions carried out in various orders, with aspects herein retained, or may involve fewer or more actions.

Definitions

As used in this specification and the appended claims, the singular forms "a," "an," and "the" include plural referents unless the content clearly dictates otherwise.

The term "about" as used herein, when referring to a numerical value or range, allows for a degree of variability in the value or range, for example, within 10%, or, in one aspect within 5%, of a stated value or of a stated limit of a range. The term "about" when modifying a numerical range includes as one numerical subrange a range defined by the exact numerical value indicated, e.g., the range of about 1 wt % to about 5 wt % includes 1 wt % to 5 wt % as an explicitly supported sub-range.

As used herein, a plurality of items, structural elements, compositional elements, and/or materials may be presented in a common list for convenience. However, these lists should be construed as though an individual member of the list is also identified as a separate and unique member. Thus, no individual member of such list should be construed as a de facto equivalent of any other member of the same list based on presentation in a common group without indications to the contrary.

Concentrations, dimensions, amounts, and other numerical data may be presented herein in a range format. A range format is used merely for convenience and brevity and should be interpreted flexibly to include the numerical values explicitly recited as the limits of the range, as well as to include all the individual numerical values or sub-ranges encompassed within that range as the individual numerical value and/or sub-range is explicitly recited. For example, a weight ratio range of about 1 wt % to about 20 wt % should be interpreted to include the explicitly recited limits of 1 wt % and 20 wt % and to include individual weights such as about 2 wt %, about 11 wt %, about 14 wt %, and sub-ranges such as about 10 wt % to about 20 wt %, about 5 wt % to about 15 wt %, etc.

EXAMPLES

The following examples illustrate the technology of the present disclosure. However, it is to be understood that the following are merely illustrative of the fluid ejection device, the method of manufacturing the fluid ejection device, and/or the fluid ejection system herein. Numerous modifications and alternative methods may be devised without departing from the present disclosure. Thus, while the technology has been described above with particularity, the following provides further detail in connection with what are presently deemed to be the acceptable examples. Additional method step elements illustrated in the examples are provided by way of example, and can be practiced with or without these additional elements.

Example 1—Formation of a Nozzle Plate of a Fluid Ejection Device

A hydrophilic material, SU-8, was spin coated onto a nozzle plate. Following application of the SU-8 thereon, a portion of the SU-8 was removed by UV exposure with a photoresist mask. A hydrophobic material, nanoceramic coating, was applied at a thickness of about 20 nm on a 14 μm thick slide of the SU-8 including an SU-8 hydrophilic material thereon, via thin-film transfer process. The thin film transfer process included selectively applying a 40 nm thick layer of the hydrophobic material on a polyethylene terephthalate film and pressing the film against the SU-8 slide at a pressure of about 20 psi's for about one minute; thereby sandwiching the hydrophobic material between the SU-8 and the polyethylene terephthalate film. The polyethylene terephthalate film was subsequently removed therefrom. The selective application included leaving open an 8 μm diameter circular area of the polyethylene terephthalate film uncoated with the hydrophobic material in order to form a counter bore area on the SU-8 slide.

Water and ink contact angles for an uncoated SU-8 slide and the hydrophobic materials independently adhered on the independent SU-8 slides were tested by an optical tensiometer. The optical tensiometer dispensed a 0.1 μL water drop or a 0.1 μL of ink on the SU-8 slide or the layer of the hydrophobic material on the SU-8 slide, a digital camera took an image of the droplet on the surface, and the contact angle of the droplet with respect to the surface of the outermost layer was digitally measured. Measurements occurred according to ASTM D7334 standard. Water and Ink contact angles measured are indicated in Table 1 below.

TABLE 1

| Contact Angles | | | | | |
|---|---|---|---|---|---|
| Substrate* | Water | Ink A | Ink B | Ink C | Ink D |
| Hydrophilic Material-SU-8 | 82.9 | 79.7 | 45 | 25 | 19 |
| Hydrophobic Material-Nasiol ® ZR53 | 116.7 | 112.9 | 60 | 42 | 45 |
| Hydrophobic Material-Nasiol ® NL272 | 113.1 | 114.6 | 65 | 52 | 46 |

*SU-8 is an epoxy-based negative photoresist commercially available from Kayaku Advanced Materials ® Inc., USA
Nasiol ® ZR53 and NL272 are nanoceramic coatings commercially available from Nasiol ® Nano Coatings-Artekya Inc, USA.

Example 2—Resistance to Ink Drool

The hydrophobic materials, Nasiol® ZR53 and NL272 were thin film transferred onto individual SU-8 nozzle plates, as indicated in Example 1, forming a non-coplanar surface including a counter bore. The nozzle plates were attached to firing chambers and fluid ejection devices were formed. The fluid ejection devices were pressure to drool tested by increasing the back pressure until the ink started to drool from an ejection opening of the nozzle plate. The data indicated that the presence of the counter bore formed from the hydrophobic material improved resistance to ink drool, as indicated in Table 2 below.

TABLE 2

| Pressure to Ink Drool (inches) | | | | | | |
|---|---|---|---|---|---|---|
| Substrate* | CMY 1 | CMY 2 | CMY 3 | Black 1 | Black 2 | Black 3 |
| SU-8 only fluid ejection device | 2.48 | 2.59 | — | 3.45 | 3.13 | — |

TABLE 2-continued

| Pressure to Ink Drool (inches) | | | | | | |
|---|---|---|---|---|---|---|
| Substrate* | CMY 1 | CMY 2 | CMY 3 | Black 1 | Black 2 | Black 3 |
| Nasiol ZR53 and SU-8 non-coplanar fluid ejection device | 8.53 | 4.53 | 15.33 | 19.64 | 9.17 | 5.40 |
| Nasiol NL272 and SU-8 non-coplanar fluid ejection device | 8.69 | 9.71 | 8.21 | 22.13 | 22.45 | 20.83 |

*SU-8 is an epoxy-based negative photoresist commercially available from Kayaku Advanced Materials ® Inc., USA
Nasiol ® ZR53 and NL272 are nanoceramic coatings commercially available from Nasiol ® Nano Coatings-Artekya Inc, USA.

Table 2 above indicates ink came out of the fluid ejection device without a hydrophobic coating thereon with ease. The SU-8 fluid ejection device took about 2 inches of water for ink to drool indicating that tilting the fluid ejector or changing ambient pressure may cause the ink to come out of the ejection opening; whereas, fluid ejection devices with a hydrophobic coating thereon required greater pressure for ink to drool, thus indicating that a fluid ejection device including both a hydrophilic material and a hydrophobic coating thereon is less susceptible to tilting during handling and transportation and pressure changes.

What is claimed is:

1. A fluid ejection device comprising:

a nozzle plate including a non-coplanar surface including a hydrophilic region of hydrophilic material having a water contact angle from about 50° to about 90° and a hydrophobic coating including a hydrophobic material having a water contact angle from about 91° to about 160°, wherein the hydrophilic region defines an opening of an ejection port and the hydrophobic coating is located outside of and around the opening and the hydrophilic region providing a recess around the opening on the nozzle plate of the fluid ejection device; and wherein the hydrophilic region defines a floor surface of a channel on the nozzle plate and the hydrophobic coating defines a sidewall surface of the channel providing an ink puddle control structure on the nozzle plate of the fluid ejection device such that the hydrophilic region comprises a wider cross-section in an area further away from the ejection port and a relatively thinner cross-section in an area closer to the ejection port.

2. The fluid ejection device of claim 1, wherein a differential between the water contact angle of the hydrophilic material and the water contact angle of the hydrophobic coating is from about 20° to about 110°.

3. The fluid ejection device of claim 1, wherein the hydrophilic material is selected from SU8, bisbenzoxyxlobutene, polyimide, piperonyl butoxide, epoxy, or a combination thereof.

4. The fluid ejection device of claim 1, wherein the hydrophobic material is selected from fluoropolymers, fluoroalkylsilanes, polysiloxanes, nanoceramic coatings, acrylic, or a combination thereof.

5. The fluid ejection device of claim 1, wherein a thickness of the hydrophobic coating ranges from about 10 nm to about 20 μm.

6. The fluid ejection device of claim 1, wherein the recess further provides the ink puddle control structure on the nozzle plate of the fluid ejection device.

7. A method of manufacturing a fluid ejection device comprising:

adhering a hydrophobic coating including a hydrophobic material having a water contact angle from about 91° to about 160° onto a nozzle plate of a fluid ejection device, wherein the nozzle plate includes a hydrophilic material having a water contact angle from about 50° to about 90°; and forming a non-coplanar surface relative to the hydrophobic coating, the non-coplanar surface having a hydrophilic region of the hydrophilic material, wherein the hydrophilic region defines an opening of an ejection port and the hydrophobic coating is located outside of and around the opening and the hydrophilic region providing a recess around the opening on the nozzle plate of the fluid ejection device, and wherein the hydrophilic region defines a floor surface of a channel on the nozzle plate and the hydrophobic coating defines a sidewall surface of the channel providing an ink puddle control structure on the nozzle plate of the fluid ejection device such that the hydrophilic region comprises a wider cross-section in an area further away from the ejection port and a relatively thinner cross-section in an area closer to the ejection port.

8. The method of claim 7, wherein the forming of the non-coplanar surface comprises adhering a hydrophobic coating at a smaller surface area than a surface area of a surface of the nozzle plate of the hydrophilic material.

9. The method of claim 7, wherein forming the non-coplanar surface comprises a subtractive process and the subtractive process includes partial removal of the hydrophobic coating by laser ablation using a laser having a wavelength ranging from about 10 nm to about 20 um to remove a portion of the hydrophobic material.

10. The method of claim 7, wherein forming the non-coplanar surface comprises a subtractive process and the subtractive process includes:

partially removing the hydrophobic coating by applying a photoresist mask over a selected area of the hydrophobic material to be removed;

exposing the nozzle plate to ultraviolet radiation, wherein an unmasked area of the hydrophobic material becomes crosslinked at an exposed area following exposure to the ultraviolet radiation; and removing the photoresist mask and uncrosslinked hydrophobic material.

11. The method of claim 7, further comprising pressing a layer of material from a transfer film against a coating of the non-coplanar surface of the fluid ejection device, thereby causing portions of the material pressed from the transfer film to adhere to the coating forming a layer of the material over the coating, wherein the material is selected from a non-sticking coating, a lubricant, anti-graffiti coating, hydrophobic coating, or a combination thereof.

12. A fluid ejection system, comprising:

a fluid ejection device including a nozzle plate with a non-coplanar surface having a hydrophilic region of hydrophilic material having a water contact angle from about 50° to about 90° and a hydrophobic coating including a hydrophobic material having a water contact angle from about 91° to about 160°, wherein the hydrophilic region defines an opening of an ejection port and the hydrophobic coating is located outside of and around the opening and the hydrophilic region providing a recess around the opening on the nozzle plate of the fluid ejection device, and wherein the hydrophilic region defines a floor surface of a channel on the nozzle plate and the hydrophobic coating defines a sidewall surface of the channel providing an ink puddle control structure on the nozzle plate of the fluid ejection device such that the hydrophilic region comprises a wider cross-section in an area further away from the ejection port and a relatively thinner cross-section in an area closer to the ejection port; and a fluid reservoir fluidly coupled to a firing chamber of the fluid ejection device, wherein the fluid reservoir is loaded or loadable with an ink composition.

13. The system of claim 12, wherein a differential between the water contact angle of the hydrophilic material and the water contact angle of the hydrophobic coating is from about 20° to about 110°.

* * * * *